US012728334B2

(12) United States Patent
Flynn

(10) Patent No.: US 12,728,334 B2
(45) Date of Patent: Sep. 8, 2026

(54) INTERACTIVE COMMUNICATION TRAINING DEVICE

(71) Applicant: Christopher Flynn, Cherrybrook (AU)

(72) Inventor: Christopher Flynn, Cherrybrook (AU)

(73) Assignee: Christopher Flynn, Cherrybrook (AU)

( * ) Notice: Subject to any disclaimer, the term of this patent is extended or adjusted under 35 U.S.C. 154(b) by 336 days.

(21) Appl. No.: 18/144,198

(22) Filed: May 7, 2023

(65) Prior Publication Data

US 2023/0356052 A1 Nov. 9, 2023

Related U.S. Application Data

(60) Provisional application No. 63/339,463, filed on May 8, 2022.

(51) Int. Cl.

| | |
|---|---|
| ***A63B 69/36*** | (2006.01) |
| ***A63B 43/00*** | (2006.01) |
| ***A63B 69/00*** | (2006.01) |
| ***A63B 71/06*** | (2006.01) |

(52) U.S. Cl.

CPC ..... *A63B 69/002* (2013.01); *A63B 43/002* (2013.01); *A63B 71/0622* (2013.01); *A63B 2071/0625* (2013.01); *A63B 2071/068* (2013.01); *A63B 2220/40* (2013.01); *A63B 2220/808* (2013.01); *A63B 2220/833* (2013.01); *A63B 2225/20* (2013.01); *A63B 2225/50* (2013.01); *A63B 2243/007* (2013.01)

(58) Field of Classification Search

CPC . A63B 69/002; A63B 43/002; A63B 71/0622; A63B 2071/0625; A63B 2071/068; A63B 2220/40; A63B 2220/808; A63B 2220/833; A63B 2225/20; A63B 2225/50; A63B 2243/007; G09B 19/0038; G09B 5/06; G10L 15/26

USPC ..... 473/446

See application file for complete search history.

(56) References Cited

U.S. PATENT DOCUMENTS

| | | | | |
|---|---|---|---|---|
| 5,636,994 | A * | 6/1997 | Tong | G09B 5/065 446/298 |
| 6,959,166 | B1 * | 10/2005 | Gabai | G09B 5/04 709/228 |
| 8,360,904 | B2 * | 1/2013 | Oleson | A43B 13/00 482/8 |
| 2007/0128979 | A1 * | 6/2007 | Shackelford | A63H 3/365 446/484 |
| 2012/0295510 | A1 * | 11/2012 | Boeckle | G09B 5/06 446/72 |
| 2015/0133025 | A1 * | 5/2015 | Ponomarev | A63H 3/28 446/484 |

(Continued)

*Primary Examiner* — Nini F Legesse

(57) ABSTRACT

The present invention presents an interactive communication training device that can be thrown and caught. The communication training device includes an information display viewable from outside the device, a microphone, a wireless transceiver and a microcontroller. A battery is contained inside the device to power electronic components. The microcontroller performs speech recognition to detect equivalence between speech information present in the microphone signal, and the information shown on the information display. Certain implementations may provide results of analytical speech processing applied to events of detected equivalence between speech information and the information shown on the information display.

13 Claims, 3 Drawing Sheets

(56) References Cited

U.S. PATENT DOCUMENTS

| | | | | |
|---|---|---|---|---|
| 2016/0057384 | A1* | 2/2016 | Nakamura | G08B 21/0208<br>348/14.02 |
| 2016/0158689 | A1* | 6/2016 | Zwayyed | B01D 53/1412<br>96/255 |

* cited by examiner

INTERACTIVE COMMUNICATION TRAINING DEVICE

RELATED APPLICATIONS

This application claims priority from U.S. Provisional Patent Application No. 63/339,463, filed on 8 May 2022 and entitled "Interactive communication training device," which is hereby incorporated by reference for all purposes.

BACKGROUND

Speech sound and organizational errors are common in the spoken language of young children. Correction of phonological and phonetic developmental errors is important for development of communication abilities, and may require the intervention of a speech pathologist over many months or years. Treatment often involves exercises targeted at the particular sound or sound system errors present in the speech of the individual child. Speech exercises may be performed on a daily basis at home and supervised by the child's parents. Play-based speech exercises involving games, drawing or physical activity are effective because they aid maintenance of the child's attention. Maintaining the attention of the child is crucial because busy parents may have only a small window of time available to assist the child with speech exercises each day. Full attention from the child is required to make the most of the limited time available daily. Play-based speech exercises built around ball games, for example throwing and catching a ball, are fun and challenging activities that help the child engage with the speech exercises, with the added benefit of developing of hand-eye coordination.

Interactive communication training devices, that allow information exchange with the user, create additional opportunities for capturing and holding attention. Features that promote interactivity include visually perceptible information displays, speakers, microphones, vibrational actuators, and visual indicators such as lights of various colors.

The benefits of play-based learning apply to multiple aspects of communication development. Interactive ball games may be applied for teaching communication skills such as reading. This approach can be particularly effective for helping children who prefer movement and activity to stay engaged during exercises aimed at improving the child's ability to recognize and articulate text. Learning a new language is another common communication training task undertaken by children and adults. Interactive communication training devices that can be utilized for play-based learning can be applied to teaching the spoken and written forms of new languages.

SUMMARY

In some embodiments, an interactive communication training device includes a projectable and catchable body, an information display and electronic components configured to enable speech sounds to be detected, analyzed, interpreted and checked for equivalence with information shown on the information display. In some cases, a sequence of steps for replacement of the information shown on the information display includes detection of equivalence between speech information and information shown on the information display. Detection of equivalence between speech information and information shown on the information display may be combined with detection of movement of the interactive communication training device to trigger replacement of the information shown on the information display.

In some embodiments, the interactive communication training device includes a projectable and catchable body, an information display and electronic components configured to enable speech sounds to be transmitted to an external computing device. The external computing device is configured to detect, analyze, and interpret speech sounds and detect equivalence between speech information and the information shown on the information display of the interactive communication training device. Furthermore in some cases, the external computing device can control the information shown on the information display of the interactive communication training device.

DETAILED DESCRIPTION

The following description of the present invention is provided as an explanation and is not intended to limit the present invention. It should be understood that variations and modifications may be made by those with ordinary skill in the art without departing from the scope and spirit of the present invention. For example, aspects of one embodiment may be used with a second embodiment to yield yet a further embodiment. It is intended that such changes and modifications be covered by the appended claims.

Figure 1B:
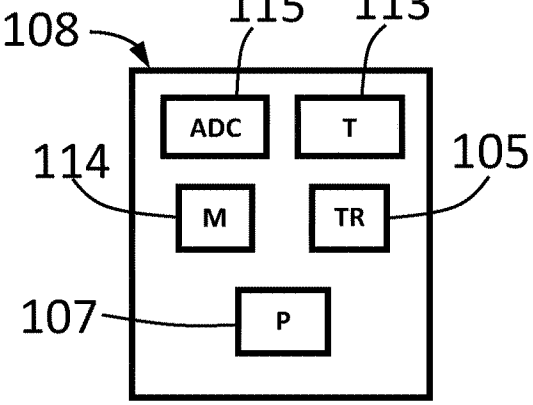
FIG. 1B is a schematic representation of an example microcontroller of the interactive communication training device of FIG. 1A.
Figure 1A:
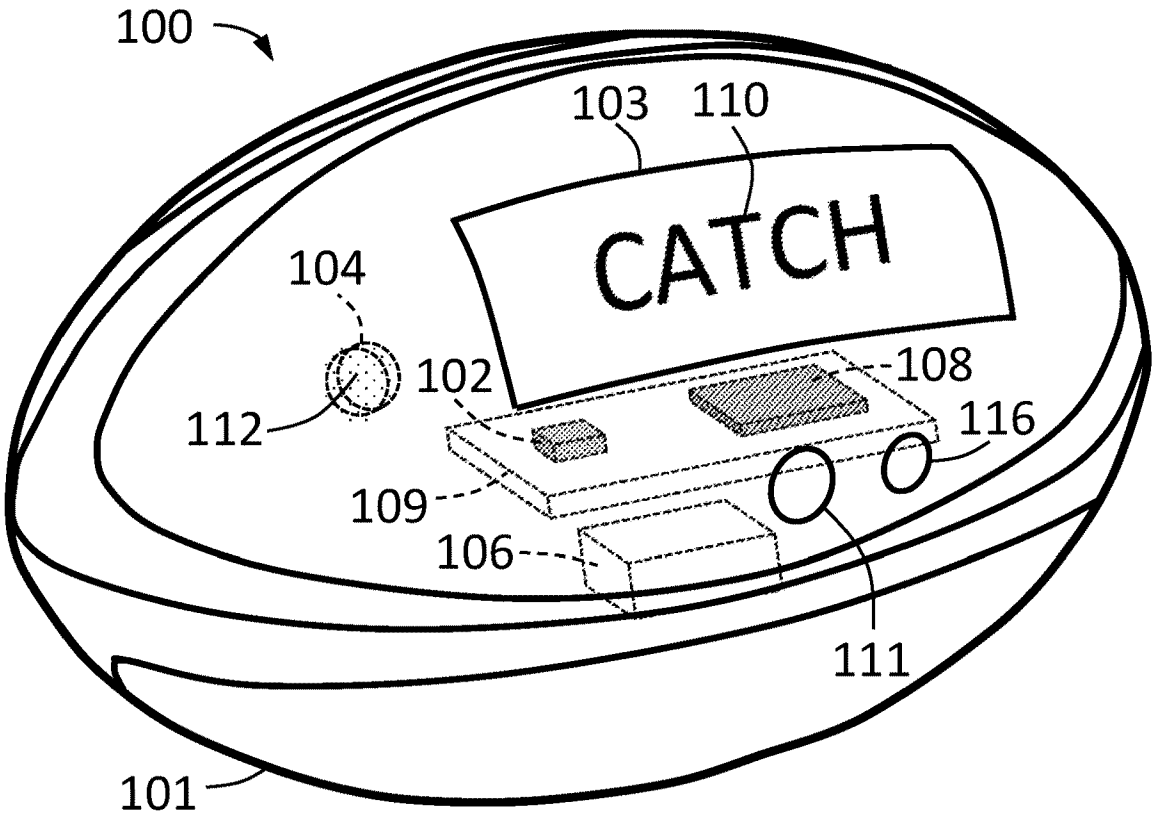
FIG. 1A shows a side perspective view of an interactive communication training device in accordance with the embodiments of the present disclosure.

FIG. 1A provides a side perspective view of an interactive communication training device 100. The example shown in FIG. 1A is a ball shaped in the form of a prolate sphereoid, typical of balls used in the games of American football, rugby, rugby league and Australian rules football. The characteristics and features of the interactive communication training device 100 may also be applied to spherical balls typical of many games such as basketball, soccer, cricket, baseball, volleyball, handball, field hockey and tennis.

The external shape of the interactive communication training device 100 is defined by a body 101 having an impact-resistant exterior. The body 101 may be constructed from a single material or from a combination of materials including synthetic and natural polymers. The body 101 may be formed by joining segments of the same material or by joining segments of different materials. In some implementations, the body 101 may be formed from a rigid plastic inner shell that protects electronic components, and a soft foam exterior lining that cushions the interactive communication training device 100 from impacts and provides a surface that can be easily gripped. The body 101 of the interactive communication training device 100 may include a transparent window, or be formed from a transparent or translucent material to allow components, such as light-emitting devices, to be viewed from outside the interactive communication training device 100. Perforations 112 may be present in the body 101 of the interactive communication training device 100 to assist transmission of sound to a microphone 104. The interactive communication training device 100 is constructed to be projected into the air, passed, clasped, caught, rolled and dropped during use. Preferably the speech training 101 ball has a weight of less than 3 kilograms. The interactive communication training device 100 may be constructed for resistance against ingress of moisture, dust or foreign bodies.

The interactive communication training device 100 includes an information display 103 viewable from outside the interactive communication training device 100. In some implementations, the information display 103 is a character display that can show a plurality of alphanumeric characters 110. The plurality of alphanumeric characters 110 may be ordered to represent sounds such as 's', 'z', 'r', 'l', 'sh', 'ch' and 'th'. In an alternative configuration, the plurality of alphanumeric characters 110 may be ordered to represent one or more words. In yet another configuration, the alphanumeric characters 110 may be arranged to represent a combination of sounds and words. In various implementations, the information display 103 may be configured to show characters from language scripts such as Arabic, Chinese, Cyrillic, Devanagari, Greek, Hebrew and Modern Latin.

In other implementations, the information display 103 is a graphic display that can show pictures, shapes, colors or images. This approach may be favored by users who cannot read, users who are learning to read but are not fluent readers, or users who are fluent readers in one language, but are learning an additional language. A graphic information display may be configured to display a combination of images and characters to provide or strengthen associations between words and images. A graphic information display may be configured to show animations, a moving image, or multiple moving images to attract and hold the attention of the user, or to convey additional information.

In various implementations, the information display 103 may be a liquid-crystal display (LCD), a light emitting diode (LED) display, an organic light-emitting diode (OLED) display, a vacuum fluorescent display (VFD), a quantum dot display, or a touch-screen display. The information display 103 may be positioned on the exterior surface of the interactive communication training device 100, or it may be positioned inside the interactive communication training device 100 and aligned with a transparent or translucent portion in the body 101 of the interactive communication training device 100. The information display 103 may be a flexible display allowing it to conform to the exterior shape of the interactive communication training device 100. A flexible information display 103 may improve impact resistance and provide an appealing aesthetic appearance to the interactive communication training device 100.

With reference to FIG. 1A, a main printed circuit board (PCB) 109 is shown in association with the interactive communication training device 100. The main PCB 109 supports components such as a microcontroller 108, and a movement sensor 102. The main PCB 109 includes electrically conductive tracks to route electrical signals between components or distribute power. The main PCB 109 may include electrically and thermally conductive plains to route electrical signals, distribute power, improve electromagnetic capability, or assist thermal management. Sockets, terminals, jacks, terminal blocks, headers or connectors may be present on the main PCB 109 to facilitate electrical connections between the main PCB 109 and components, such as a battery 106, an advance button 111 or a microphone 104. The main PCB 109 is preferentially located inside the interactive communication training device 100.

The microphone 104 converts sound present in the surrounding environment to an electrical microphone signal. Depending on the implementation, microphone 104 may be a condenser microphone, a MEMS microphone, or a contact microphone. The microphone 104 may be positioned close to the exterior surface of the interactive communication training device 100 to improve collection of sound by the microphone 104. Collection of sound by the microphone 104 may be enhanced by aligning the microphone 104 with perforations 112 in the body 101 of the interactive communication training device 100. In some implementations, the microphone 104 is positioned on the main PCB 109. In some implementations, the microphone 104 is positioned on a secondary PCB that is electrically connected to the main PCB 109 by wires. The sound frequency detection range of the microphone 104 overlaps fully or partially with the typical frequency range of the human voice.

In some implementations a movement sensor 102 provides a signal relating to movement of the interactive communication training device 100. In some implementations the movement sensor 102 is an accelerometer that provides a measure of acceleration. The accelerometer may provide an analog signal or a digital signal. Integration of the measured acceleration over time provides velocity. Integration of the velocity over time provides position. In some implementations, the movement sensor 102 may be a gyroscope that provides an analog signal or digital signal relating to angular motion. The movement sensor 102 may be located on or near the exterior surface of the interactive communication training device 100. In implementations where the movement sensor 102 is not located on the main PCB 109, a physical electrical connection between the movement sensor 102 and the main PCB 109 can be made using wires. In some implementations, the movement sensor 102 is positioned on a secondary PCB that is electrically connected to the main PCB 109 by wires.

With reference to FIG. 1A, a microcontroller 108 is supported by the main PCB 109. With reference to FIG. 1B, the microcontroller 108 contains multiple functional blocks including a wireless transceiver 105, a processor 107, a timer 113, a memory 114 and an analog-to-digital converter (ADC) 115. In some implementations, the various functional blocks may not be integrated into the microcontroller 108. For example, the wireless transceiver 105 may not be integrated into the microcontroller 108. The wireless transceiver 105 may be in the form of a discrete module located on the main PCB 109 and separate to the microcontroller 108. In some implementations the various functional blocks may have multiple instances, with individual instances of functional blocks located internal or external to the microcontroller. For example, the microcontroller may interface with memory blocks located external to the microcontroller. The microcontroller 108 interfaces with multiple components, including the movement sensor 102, information display 103, microphone 104 and wireless transceiver 105.

A battery 106 provides power to electronic components within the interactive communication training device 100. The battery 106 may be a single-use replaceable energy storage device that is removed from the interactive communication training device 100 when it is depleted of charge, and replaced with an equivalent battery. In other implementations, the battery 106 is a rechargeable energy storage device. A rechargeable battery 106 may be charged wirelessly, or from an external power source using a temporarily-wired connection to a battery charging socket embedded in the interactive communication training device 100. The main PCB 109 may support a battery charge management circuit to regulate battery charging, monitor battery condition, extend battery run time, or extend battery life. A power on/off button 116 accessible from the exterior of the interactive communication training device 100 can be utilized to power down electronic devices within the interactive communication training device 100, thereby extending the time between battery recharge or replacement events. The power on/off button 116 may be interfaced with the microcontroller 108. A visual indication of the battery 106 charge level may be provided on the information display 103.

The interactive communication training device 100 can be used during speech training exercises. Use of the interactive communication training device 100 during speech training exercises may provide benefits such as improved user engagement, and greater enjoyment. In one usage example, a child and a speech pathologist can take turns throwing, passing or rolling the interactive communication training device to each other. When the child receives the interactive communication training device 100, the child views the information display 103, which in this example, is configured to show a word. Prompted by the speech pathologist, the child attempts to pronounce the word shown on the information display 103, or articulates a sentence containing the word shown on the information display 103. The child throws or rolls the interactive communication training device 100 to the speech pathologist, which coincides with replacement of the word on the information display 103 with a new word. Replacement of the word on the information display 103 may be triggered by the speech pathologist pressing the advance button 111 or by another means. The speech pathologist views the new word and returns the interactive communication training device 100 to the child, who attempts to pronounce the new word shown on the information display 103.

Exchange of the interactive communication training device 100 between the child and the speech pathologist is a play-based speech training exercise that provides opportunities for the child to practice verbalization of the information presented on the information display 103. The speech training exercise continues for a duration deemed appropriate by the speech pathologist. In another usage example, the interactive communication training device 100 may be exchanged between a child and a parent during a play-based speech training exercise. In yet another usage example, the interactive communication training device 100 may be exchanged between a language student and a language teacher during a play-based language learning exercise.

In some implementations, the microcontroller 108 is configured over a wireless communications link to an external computing device located some distance from the interactive communication training device 100. The external computing device may consist of a smart phone, smart watch, tablet, personal computer, server, media player, gaming console, smart hub, cloud computing hardware or edge computing device. An application running on the external computing device can be used to compile information lists, possibly comprising sounds, words, pictures, shapes, colors or images that can be shown on the information display 103. Information lists may be transferred from the external computing device to the memory 114 of the microcontroller 108 over the wireless communications link effected by the wireless transceiver 105. Similarly, information lists stored in the memory 114 of the microcontroller 108 may be read by the external computing device over the wireless communications link using an application running on the external computing device. Configurable aspects of the information display 103, such as brightness, may also be configured over the wireless communications link using an application running on the external computing device. Operational aspects of the information display 103, such as the information type shown on the information display 103, or the information selection method when information is replaced on the information display 103, may also be configured over the wireless communications link using an application running on the external computing device. When information is replaced on the information display 103, selection methods include random selection and sequential selection in a pre-defined order from an information list.

In some implementations, the interactive communication training device 100 includes an advance button 111, that when pressed, triggers replacement of the information shown on the information display 103. The advance button 111 may consist of a mechanical button, a capacitive touch button, or a Hall Effect touch button. In some implementations the information display 103 is a touch-sensitive display, and the advance button 111 is implemented as an icon on the information display 103. When the advance button 111 is pressed, the information shown on the information display 103 is replaced with a different piece of information from an information list. The advance button 111 can be mounted on the main PCB 109, or supported in the body 101 and electrically connected to the main PCB 109 by wires. The advance button 111 may be used by the speech pathologist to replace the information shown on the information display 103. The advance button 111 may be used when the speech pathologist desires the information display 103 to show a specific piece of information contained within an information list. The advance button 111 may be pressed repeatedly to cycle through the information list, with each press of the advance button 111 replacing the information shown on the information display 103 with a different piece of information from the information list.

The microcontroller 108 may be configured to perform a speech recognition function on the signal provided by the microphone 104. The ADC 115 digitizes the signal provided by the microphone 104. In some implementations, the microcontroller 108 conditions the microphone signal by performing filtering, sound normalization or frequency band separation. The microcontroller 108 may perform a speech recognition process to identify speech information contained in the signal provided by the microphone 104. The speech recognition process may consist of performing time segmentation of the digitized microphone signal, phoneme matching, contextual phoneme analysis using a statistical model, and comparison with a library of known sounds, words, phrases or sentences.

In some implementations, the microcontroller 108 is configured to detect equivalence between the speech information contained in the signal provided by the microphone 104, and the information shown on the information display 103. A continuous stream of speech information recognized by the microcontroller 108 can be converted to a format which allows a direct comparison with the information shown on the information display 103. For example, if the information display 103 shows a single word represented as text, the speech information may be converted to text by the microcontroller 108 to facilitate a direct comparison with the word shown on the information display 103. If the information display 103 shows an image, there may be multiple words that adequately describe the image. Consequently there may be multiple words which qualify as equivalent to the information shown on the information display 103. In some implementations, the microcontroller 108 may be configured to perform a speech recognition function in more than one spoken language. In some implementations, the microcontroller 108 may be configured to perform a speech recognition function in a different spoken language to that normally associated with the language script that information is presented on the information display 103.

Detection of equivalence between speech information and the information shown on the information display 103 may be triggered by one or more distinct packets of speech information. If the information display 103 shows a sound, numerous words can contain the sound, and any of these words may trigger detection of equivalence between the speech information and the information shown on the information display 103. If the information display 103 shows a sound, detection of the sound itself pronounced purely as a sound, and not within a word, may trigger detection of equivalence between the speech information and the information shown on the information display 103. If the information display 103 shows multiple sounds, words or images, detection of equivalence between the speech information and the information shown on the information display 103 may be triggered by recognition of speech information equivalent to one, several, or all of the sounds, words or images shown on the information display 103.

In some implementations, the microphone signal may be transmitted in real time to an external computing device over a wireless communications link effected by the wireless transceiver 105. Processes performed on the microphone signal such as speech recognition, and detection of information equivalence between speech information identified in the microphone signal, and the information shown on the information display 103, may be performed on the external computing device. The outputs of processes performed on the microphone signal may be transferred from the external computing device to the interactive communication training device 100, or provided as inputs to analytical processes performed on the external computing device, such as analytical processing of speech information. The external computing device may control the information shown on the information display 103 by sending messages to the interactive communication training device 100 over a wireless communications link effected by the wireless transceiver 105. Messages sent by the external computing device to the interactive communication training device 100 may be interpreted and actioned by the microcontroller 108.

Analytical information derived from analytical processing of speech information may be utilized for tracking progress in correction of phonological or phonetic developmental errors. In some implementations, detection of equivalence between speech information and the information shown on the information display 103 may be followed by analytical processing of the speech information that was detected to be equivalent the information shown on the information display 103.

Analytical processing of the speech information that was detected to be equivalent to the information shown on the information display 103 may comprise identification and analysis of mispronounced phonemes within the speech information. Analytical processing of speech information may be performed by the microcontroller 108, or by an application running on an external computing device. Analytical processing of speech information on an external computing device is enabled by transfer of the speech information from the interactive communication training device 100 to an external computing device over a wireless communications link effected by the wireless transceiver 105.

The analysis of mispronounced phonemes may provide a tally of mispronounced phonemes, organized by phoneme type. Analysis of mispronounced phonemes may provide the ratio of mispronounced phonemes to correctly pronounced phonemes, organized by phoneme type. Analysis of mispronounced phonemes may also provide statistics pertaining to the position of mispronounced phonemes in individual words, such as probabilities of the mispronounced phonemes occurring at the beginning, middle or end of words. Analysis of mispronounced phonemes may provide statistics pertaining to the position within sentences of words containing mispronounced phonemes. The results of analytical processing of speech information may be stored in the memory 114 of microcontroller 108, memory external to the processor, or transferred to an external computing device over a wireless communications link effected by the wireless transceiver 105, and stored in a memory associated with the external computing device.

The results of analytical processing of speech information may be stored with metadata including the date and time that the analyzed speech information was captured. The results of analytical processing of speech information may be organized in chronological order by an application running on an external computing device, thereby enabling trends in the type and frequency of mispronounced phonemes over time to be readily viewed or analyzed.

Detection of equivalence between the speech information and the information shown on the information display 103, can be used in conjunction with detection of movement of the interactive communication training device 100, to trigger replacement of the information shown on the information display 103. Detection of movement of the interactive communication training device 100 can be achieved through monitoring the signal provided by the movement sensor 102. Triggering replacement of the information shown on the information display 103 using a combination of speech information and movement of the interactive communication training device 100 overcomes problems associated with using either recognized speech information exclusively, or movement of the interactive communication training device 100 exclusively, to trigger the replacement of information on the information display 103. If interactive communication training device 100 movement is used exclusively to trigger the replacement of information, the information shown on the information display 103 may be replaced inadvertently if the interactive communication training device 100 is dropped on the ground.

In one usage example, where the interactive communication training device 100 is repeatedly exchanged between a child and speech pathologist by throwing, passing or rolling, the speech pathologist desires to view the information shown on the information display 103 before the child attempts to articulate the information shown on the information display 103. If movement is used exclusively to trigger the replacement of information, the information shown on the information display 103 may change when the speech pathologist throws, passes or rolls the interactive communication training device 100 to the child, which would make the speech pathologist unaware of the information shown on the information display 103 when viewed by the child, hindering the ability of the speech pathologist to assist the child with articulation. This problem can be overcome by triggering replacement of the information shown on the information display 103 using a combination of speech recognition and movement sensing. Identified speech information can be compared to the information shown on the information display 103. Articulation of the information shown on the information display 103 by the child, results in detection of equivalence between the speech information and the information shown on the information display 103. Such an event of information equivalence detection, in combination with subsequent detection of movement of the interactive communication training device 100, indicates that the child has articulated the information and is returning the interactive communication training device to the speech pathologist. At this point the information shown on the information display 103 is replaced with new information for the child to articulate when the interactive communication training device 100 is returned to the child, with the benefit that the speech pathologist is able to view the new information shown on the information display 103 before the speech pathologist returns the interactive communication training device 100 to the child.

In some implementations, when the advance button 111 is pressed, the information shown on the information display 103 is replaced with new information. If a child attempts to articulate the information shown on the information display 103, but is unsuccessful, equivalence between the speech information and the information shown on the information display 103 will not be detected. When the child returns the interactive communication training device 100 to the speech pathologist, the speech pathologist may replace the information shown on the information display 103 by pressing the advance button 111, to allow the child to attempt articulation of a new piece of information on the information display 103 when the interactive communication training device 100 is returned to the child. Alternatively, the speech pathologist may choose not to press the advance button 111, instead returning the interactive communication training device 100 to the child with the same information shown on the information display 103, to allow the child to make another articulation attempt after the previous unsuccessful articulation effort.

In some implementations a virtual advance button, having a similar functionality to the advance button 111, is provided on an external computing device. Real time communication between the interactive communication training device 100 and an external computing device can occur over a wireless communications link effected by the wireless transceiver 105. The external computing device may communicate to the interactive communication training device 100 by message transfer that the virtual advance button on the external computing device was pressed. Upon the interactive communication training device 100 receiving a message that the virtual advance button was pressed, the interactive communication training device 100 performs the same response that it would perform if the advance button 111 was pressed. The virtual advance button may be realized as a touch-screen button, mechanical button, capacitive touch button, or a Hall Effect touch button.

In some implementations, replacement of information on the information display may be triggered by a verbal advance command. A specific verbal advance command consisting of one or more spoken words may be identified during speech recognition performed by the microcontroller 108 on the signal provided by the microphone 104. When the verbal advance command is identified, the interactive communication training device 100 performs the same response that it would perform if the advance button 111 was pressed. In some implementations, the advance button 111 may be omitted from the interactive communication training device 100 and replacement of information on the information display 103 may be triggered by a verbal advance command or a virtual advance button.

In some implementations, the interactive communication training device 100 includes a visible light emitter controlled by the microcontroller 108. The visible light emitter may be illuminated when equivalence is detected between the speech information and the information shown on the information display 103. Illumination of the visible light emitter may show the child that their attempt to articulate the information shown on the information display 103 was recognized by the interactive communication training device 100. Illumination of the visible light emitter may prompt the child to return the interactive communication training device 100 to the speech pathologist. The visible light emitter may comprise an LED, an array of LEDs, or a lamp. In some implementations, the visible light emitter is illuminated momentarily after detection of an information equivalence event. In some implementations, the visible light emitter is turned on continuously after detection of an information equivalence event, and turned off when movement of the interactive communication training device 100 is detected. In some implementations, the visible light emitter is cycled on and off periodically after equivalence is detected between the speech information and the information shown on the information display 103, until movement of the interactive communication training device 100 is detected. In some implementations, the information display 103 may be utilized as the visible light emitter. For example, after detection of equivalence between the speech information and the information shown on the information display 103, the information display 103 may be cycled on and off periodically until movement of the interactive communication training device 100 is detected.

In some implementations, the interactive communication training device 100 includes a speaker controlled by the microcontroller 108. The speaker may provide an audible output when equivalence is detected between the speech information and the information shown on the information display 103. In some implementations the speaker may provide an audible output that provides the user with audible feedback on how to improve the correctness of speech sounds, pronunciation or comprehension.

In some implementations, the interactive communication training device 100 may include an audio recorder controlled by the microcontroller 108. The audio recorder may record speech segments during time windows that span a condition of equivalence between the speech information and the information shown on the information display 103. In doing so, the recorded audio may comprise a compilation of speech segments which contain speech information that matched the information shown on the information display 103 at the times that the speech segments were articulated. Interactive communication training device 100 may include buttons to start, pause, or stop audio recording. The information display 103 may display a visual indicator while audio recording is in progress. In some implementations, recordings captured by the audio recorder may be transferred to an external computing device over a wireless link effected by the wireless transceiver 105. Recorded speech segments may be replayed, reviewed, analyzed or shared.

Figure 2:
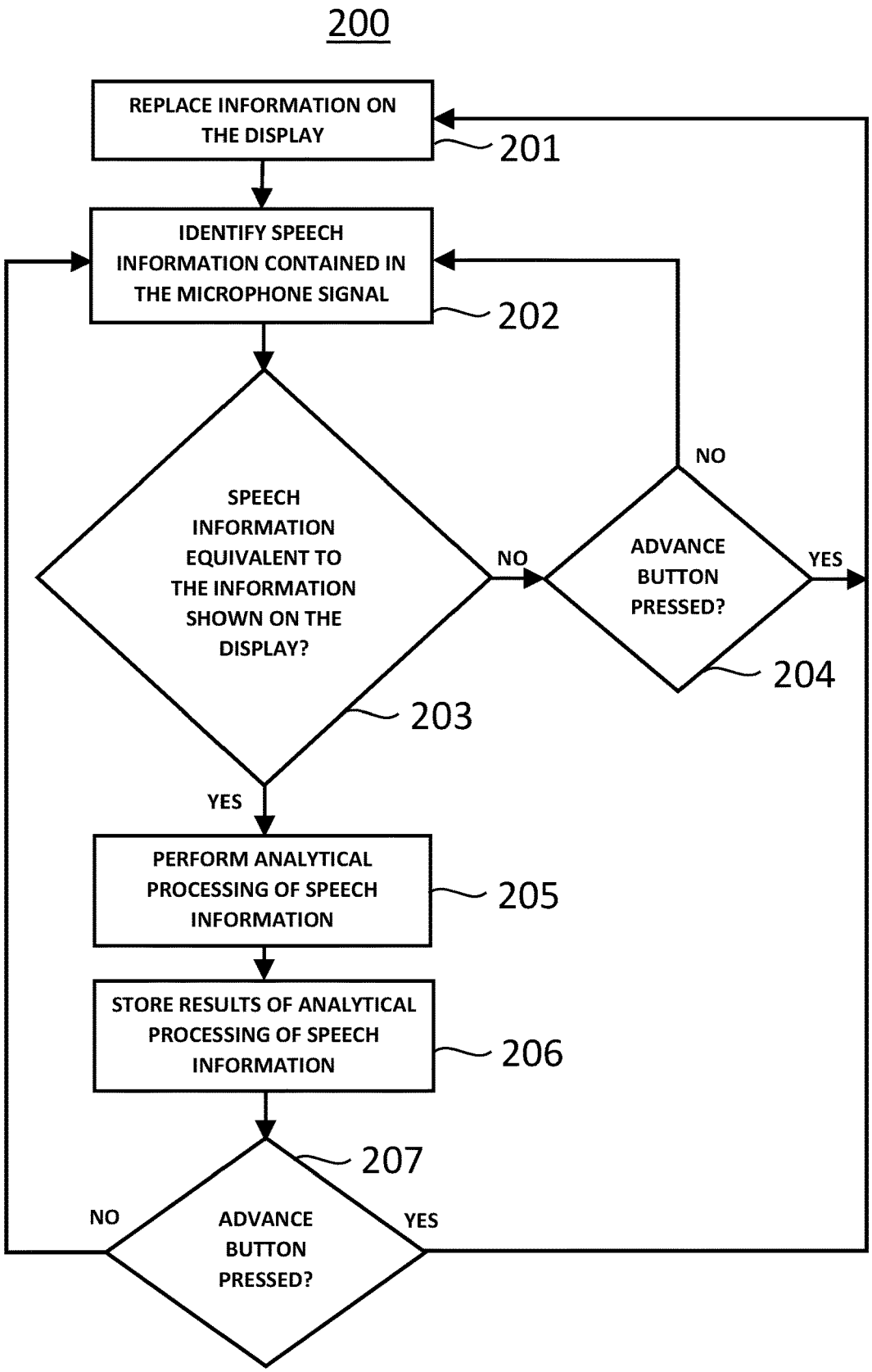
FIG. 2 is an exemplary flow chart representing functions associated with interactive communication training device operation in accordance with the embodiments of the present disclosure.

FIG. 2 depicts a flow chart 200 which illustrates the functionality of the interactive communication training device 100 in one of the possible implementations. Step 201 involves replacement of the information that is shown on the information display 103. In step 201, the information shown on the information display 103 is replaced with a different piece of information from an information list.

Flow chart 200 also includes step 202. Step 202 involves a speech recognition process applied to the signal provided by the microphone 104. The speech recognition process is concerned with identification of speech information contained in the signal provided by the microphone 104. The speech recognition process in step 202 may also include conversion of the speech information to a format that facilitates a direct comparison to the information shown on the information display 103.

Flow chart 200 also includes step 203. Step 203 involves checking for equivalence between speech information identified in the signal provided by the microphone 104, and the information shown on the information display 103. If equivalence between the speech information and the information shown on the information display 103 is not detected in step 203, the system moves to step 204. Step 204 checks if the advance button 111 has been pressed. If the advance button 111 has not been pressed since the last time that the information shown on the information display 103 was replaced, the system moves to step 202 where a speech recognition process is applied to the signal provided by the microphone 104. Alternatively, if the advance button 111 has been pressed since the last time that the information shown on the information display 103 was replaced, the system proceeds to step 201 where the information shown on the information display 103 is replaced.

If equivalence between the speech information identified in step 202 and the information shown on the information display 103 is detected in step 203, the system moves to step 205 which involves performing analytical processing of speech information. Following step 205, the results of analytical processing of speech information are stored in step 206.

Step 207 checks if the advance button 111 has been pressed. If the advance button 111 has not been pressed since the last time that the information shown on the information display 103 was replaced, the system moves to step 202 were processing of the microphone signal continues to identify speech information within the microphone signal. Alternatively, if the advance button 111 has been pressed since the last time that the information shown on the information display 103 was updated, the system proceeds to step 201 where the information shown on the information display 103 is replaced.

Figure 3:
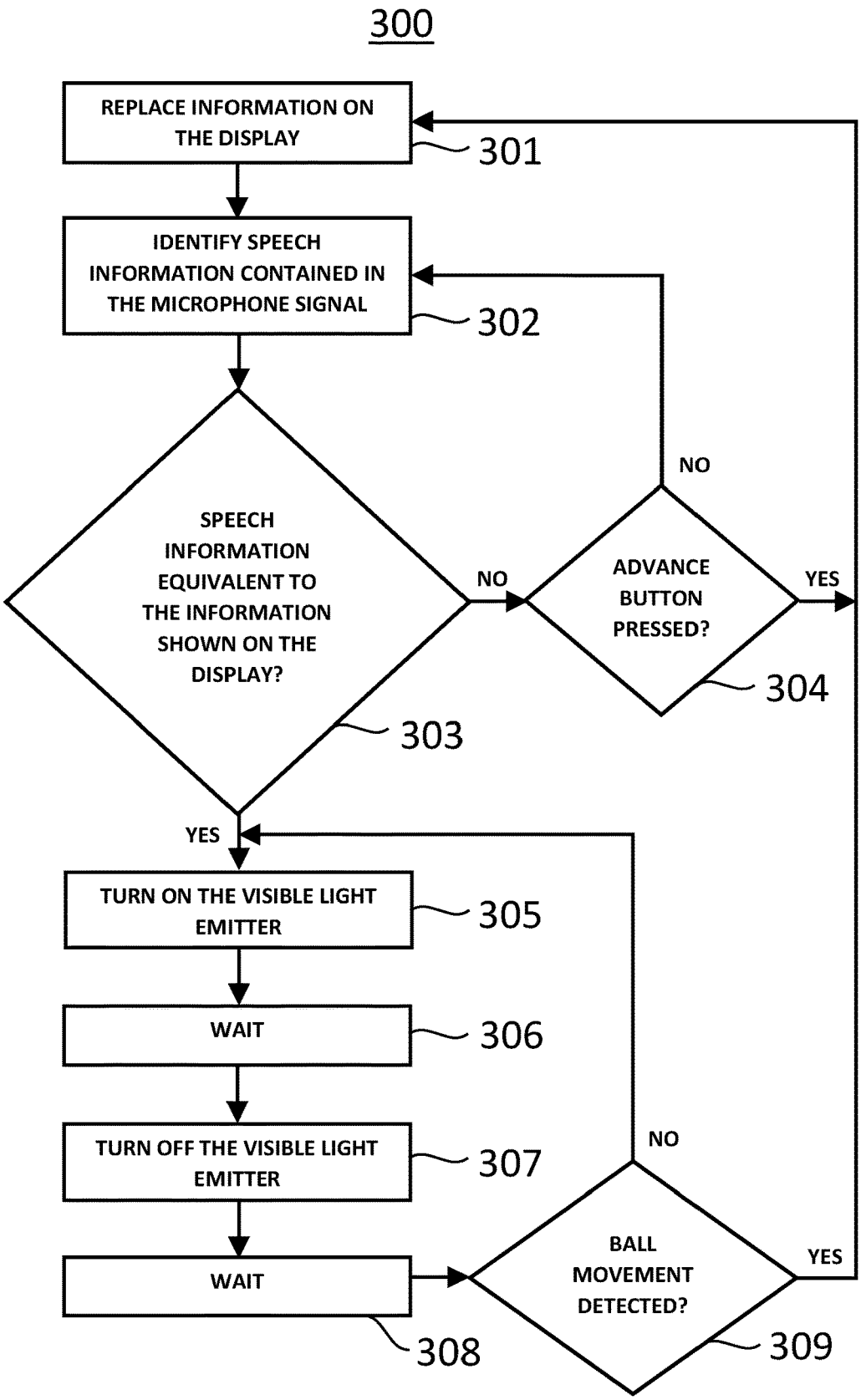
FIG. 3 is an exemplary flow chart representing functions associated with interactive communication training device operation in accordance with the embodiments of the present disclosure.

FIG. 3 depicts a flow chart 300 which illustrates the functionality of the interactive communication training device 100 in one of the possible implementations. Step 301 involves replacement of the information that is shown on the information display 103. In step 301 the information shown on the information display 103 is replaced with a different piece of information from an information list.

Flow chart 300 also includes step 302. Step 302 involves a speech recognition process applied to the signal provided by the microphone 104. The speech recognition process is concerned with identification of speech information contained in the signal provided by the microphone 104. The speech recognition process in step 302 may also include conversion of the speech information to a format that facilitates a direct comparison to the information shown on the information display 103.

Flow chart 300 also includes step 303. Step 303 involves checking for equivalence between speech information identified in step 302 the signal provided by the microphone 104, and the information shown on the information display 103. If equivalence between the speech information and the information shown on the information display 103 is not detected in step 303, the system moves to step 304. Step 304 checks if the advance button 111 has been pressed. If the advance button 111 has not been pressed since the last time that the information shown on the information display 103 was replaced, the system moves to step 302 where a speech recognition process is applied to the signal provided by the microphone 104. Alternatively, if the advance button 111 has been pressed since the last time that the information shown on the information display 103 was updated, the system moves to step 301 where the information shown on the information display 103 is replaced.

If equivalence between the speech information identified in step 302 and the information shown on the information display 103 is detected in step 303, a visible light emitter is turned on in step 305. The visible light emitter remains on during a subsequent first wait step 306. The duration of the first wait step 306 can be typically 0.1 to 2 seconds. Subsequently, in step 307, the visible light emitter is turned off. Step 307 is followed by a second wait step 308. The duration of the second wait step 308 may be the same as the duration of the first wait step 306, or the duration of the second wait step 308 may be different to the duration of the first wait step 306. The timer 113 contained in the microcontroller 108 may be utilized for timing first wait step 306 and second wait step 308.

Flow chart 300 also includes step 309 which involves checking if movement of the interactive communication training device 100 was detected by the movement sensor 102, after detection in step 303 of equivalence between speech information and the information shown on the information display 103. If movement of the interactive communication training device 100 was not detected since the detection of equivalence between speech information and the information shown on the information display 103, the system moves from step 309 to step 305 where the visible light emitter is turned on. This sequence of steps effectively results in the visible light emitter flashing on and off after detection of equivalence between speech information and the information shown on the information display 103, until movement of the interactive communication training device 100 is detected. In step 309, if movement of the interactive communication training device 100 was detected since the detection of equivalence between speech information and the information shown on the information display 103, the system then moves to step 301, in which the information shown on the information display 103 is replaced with a different piece of information.

What is claimed is:

1. An interactive communication training device comprising:

a projectable and catchable body comprising a rigid inner shell that houses electronic components and a compliant outer layer that provides cushioning and grip, the body being structurally configured to withstand repeated impacts from throwing, catching and rolling;

an information display viewable from the exterior of the body, and configured to present alphanumeric characters or graphics from an information list;

a microphone positioned to capture spoken input from a user;

a movement sensor that provides a signal relating to movement of the interactive communication training device;

a wireless transceiver;

a battery that provides power to electronic components within the body; and a microcontroller operatively coupled to the information display, the microphone, the movement sensor, and the wireless transceiver, the microcontroller being configured to:

control the information shown on the information display;

process the microphone signal and recognize speech information contained in the microphone signal;

detect equivalence between the speech information and the information shown on the information display; and replace the information shown on the information display after detecting both (i) equivalence between the recognized spoken input present in the microphone signal and the displayed information, and (ii) motion of the interactive communication training device detected by the movement sensor.

2. The device of claim 1, further comprising an advance button for triggering replacement of the information shown on the information display.

3. The device of claim 1, wherein the microcontroller is configured to perform analytical processing of speech information detected to be equivalent to the information shown on the information display.

4. The device of claim 1, further comprising a visible light emitter for visual indication of detection of equivalence between the speech information and the information shown on the information display.

5. The device of claim 1, further comprising a speaker for audible indication of detection of equivalence between the speech information and the information shown on the information display.

6. The device of claim 1, further comprising an audio recorder for recording segments of the microphone signal.

7. The device of claim 6, wherein the microcontroller is configured to record speech segments occurring during time windows that span a condition of equivalence between the speech information and the information shown on the information display.

8. The device of claim 1, wherein the microcontroller and wireless transceiver are configured to realize a wireless communications link to an external computing device.

9. The device of claim 8, wherein the microcontroller is configured to receive information lists from an external computing device over a wireless communications link.

10. The device of claim 8, wherein configurable parameters of the interactive communication training device are configured over a wireless communications link using an external computing device.

11. The device of claim 8, wherein stored information is transferrable to an external computing device over a wireless communications link.

12. The device of claim 8, wherein the microcontroller is configured to replace the information shown on the information display in response to a message transferred from an external computing device.

13. An interactive communication training system comprising:

an interactive communication training device including:

a projectable and catchable body comprising a rigid inner shell that houses electronic components and a compliant outer layer that provides cushioning and grip, the body being structurally configured to withstand repeated impacts from throwing, catching and rolling;

an information display;

a microphone;

a movement sensor that provides a signal relating to movement of the interactive communication training device;

a wireless transceiver;

a battery;

and a microcontroller configured to transmit the microphone signal to an external computing device; and an external computing device configured to process the microphone signal, recognize speech information contained in the microphone signal, detect equivalence between the speech information and the information shown on the information display, and trigger replacement of the information shown on the information display after detecting both (i) equivalence between the recognized spoken input present in the microphone signal and the displayed information, and (ii) motion of the interactive communication training device detected by the movement sensor.

* * * * *